US011729866B2

(12) United States Patent
Nakano

(10) Patent No.: US 11,729,866 B2
(45) Date of Patent: Aug. 15, 2023

(54) HEATER

(71) Applicant: Toshiba Lighting & Technology Corporation, Yokosuka (JP)

(72) Inventor: Hiroki Nakano, Yokosuka (JP)

(73) Assignee: Toshiba Lighting & Technology Corporation, Yokosuka (JP)

( * ) Notice: Subject to any disclaimer, the term of this patent is extended or adjusted under 35 U.S.C. 154(b) by 679 days.

(21) Appl. No.: 16/803,403

(22) Filed: Feb. 27, 2020

(65) Prior Publication Data

US 2020/0374986 A1 Nov. 26, 2020

(30) Foreign Application Priority Data

May 20, 2019 (JP) ..... 2019-094303

(51) Int. Cl.

| | |
|---|---|
| ***H05B 3/42*** | (2006.01) |
| ***H01J 11/50*** | (2012.01) |
| ***H05B 3/00*** | (2006.01) |
| ***H05B 3/14*** | (2006.01) |

(52) U.S. Cl.

CPC ..... *H05B 3/42* (2013.01); *H01J 11/50* (2013.01); *H05B 3/0033* (2013.01); *H05B 3/145* (2013.01); *H05B 2203/032* (2013.01)

(58) Field of Classification Search

CPC .. H01K 1/06; H01K 3/06; H01K 1/24; H01K 1/18; H05B 3/42; H05B 3/145; H05B 3/44; H05B 3/04; H05B 3/0033; H05B 3/009; H05B 2203/032; H01J 11/50

USPC ..... 219/553

See application file for complete search history.

(56) References Cited

U.S. PATENT DOCUMENTS

| | | | | | |
|---|---|---|---|---|---|
| 3,313,921 | A * | 4/1967 | Mohn | H05B 3/44 | 392/407 |
| 4,295,883 | A * | 10/1981 | Lajh | B01F 25/312 | 266/220 |
| 5,782,253 | A * | 7/1998 | Cates | B24C 1/003 | 134/201 |
| 5,985,005 | A * | 11/1999 | Mizobe | B01D 53/268 | 96/10 |
| 6,071,469 | A * | 6/2000 | Rohlin | C22C 29/08 | 419/57 |

(Continued)

FOREIGN PATENT DOCUMENTS

| | | | |
|---|---|---|---|
| EP | 2222131 | A1 | 8/2010 |
| EP | 2291055 | A1 | 3/2011 |
| JP | 2006-286372 | A | 10/2006 |

*Primary Examiner* — Eric S Stapleton

(74) *Attorney, Agent, or Firm* — Banner & Witcoff, Ltd.

(57) ABSTRACT

A heater according to an embodiment includes: a tubular portion; a sealing portion provided in each of both end portions of the tubular portion; a conductive portion provided inside each sealing portion; a heating portion provided inside the tubular portion, extending along a tube axis of the tubular portion, and including carbons; an inner lead provided in each sealing portion so that one end portion side is connected to the conductive portion and the other end portion side is exposed into the tubular portion; and a connection portion connected to each of both end portions of the heating portion inside the tubular portion. A bent portion is provided in an end portion opposite to the conductive portion in each inner lead. The bent portion is bent in a direction in which the sealing portions face each other and is provided inside a hole of the connection portion.

19 Claims, 6 Drawing Sheets

(56) References Cited

U.S. PATENT DOCUMENTS

| | | | | |
|---|---|---|---|---|
| 7,749,863 | B1 * | 7/2010 | Micovic | H01L 21/76254 438/459 |
| 8,240,709 | B1 * | 8/2012 | Quioc | B60R 21/2644 280/741 |
| 8,393,641 | B1 * | 3/2013 | Quioc | B60R 21/2644 280/741 |
| 9,051,225 | B1 * | 6/2015 | Quioc | B60R 21/2644 |
| 2003/0188963 | A1 * | 10/2003 | Takikawa | B82Y 30/00 204/173 |
| 2006/0107831 | A1 * | 5/2006 | Karwacki, Jr. | B01D 53/04 95/116 |
| 2007/0098377 | A1 * | 5/2007 | Konishi | F24C 7/06 392/407 |
| 2010/0080522 | A1 * | 4/2010 | Cody | G02B 6/4475 65/407 |
| 2010/0116813 | A1 * | 5/2010 | Nishio | H05B 3/44 219/520 |
| 2012/0070667 | A1 * | 3/2012 | Malet | C01B 32/162 427/337 |
| 2013/0161647 | A1 * | 6/2013 | Fujiwara | H01L 29/02 257/77 |
| 2013/0220302 | A1 * | 8/2013 | Han | F23D 14/10 431/355 |
| 2015/0232367 | A1 * | 8/2015 | Joubaud | C03B 35/14 65/169 |
| 2016/0176152 | A1 * | 6/2016 | MacKelvie | B32B 3/02 156/60 |
| 2018/0286972 | A1 * | 10/2018 | Tarakji | H01L 29/4236 |

* cited by examiner

HEATER

CROSS-REFERENCE TO RELATED APPLICATIONS

This application is based upon and claims the benefit of priority from Japanese Patent Application No. 2019-094303, filed on May 20, 2019; the entire contents of which are incorporated herein by reference.

FIELD

Embodiments described herein relate generally to a heater.

BACKGROUND

A heater that heats an object by radiant heat is known. Such a heater includes a bulb, a heating portion provided inside the bulb, a sealing portion provided in both end portions of the bulb, a thin film-shaped conductive portion provided inside the sealing portion, and an outer lead. One end of the outer lead inside the sealing portion is electrically connected to the conductive portion and the other end thereof is exposed from the sealing portion.

Here, the spectrum of the emitted light changes when the material of the heating portion changes. For example, in the case of a carbon heater including a heating portion including carbons, a peak occurs in the energy of emitted light at wavelengths of 2 μm to 4 μm. Since the peak of the water absorption spectrum is about 3 μm, an object having a high water content can be efficiently heated by using the carbon heater. However, the heating portion including carbons is not easily and directly connected to a conductive portion. For that reason, in the case of the carbon heater, a connection portion electrically connected to the end portion of the heating portion and an inner lead having one end electrically connected to the connection portion and the other end electrically connected to the conductive portion are provided.

Further, in recent years, higher power heaters are required. For that reason, the temperature of the connection portion and the inner lead tends to increase. Generally, the connection portion and the inner lead are connected to each other by welding, but when the temperature of the welded portion increase, a crack or the like easily occurs in the welded portion. When the crack or the like occurs in the welded portion, the inner lead is separated from the connection portion in some cases. For that reason, there is concern that the life of the heater is shortened.

Therefore, it is desired to develop a heater capable of extending its life.

DETAILED DESCRIPTION

Figure 1:
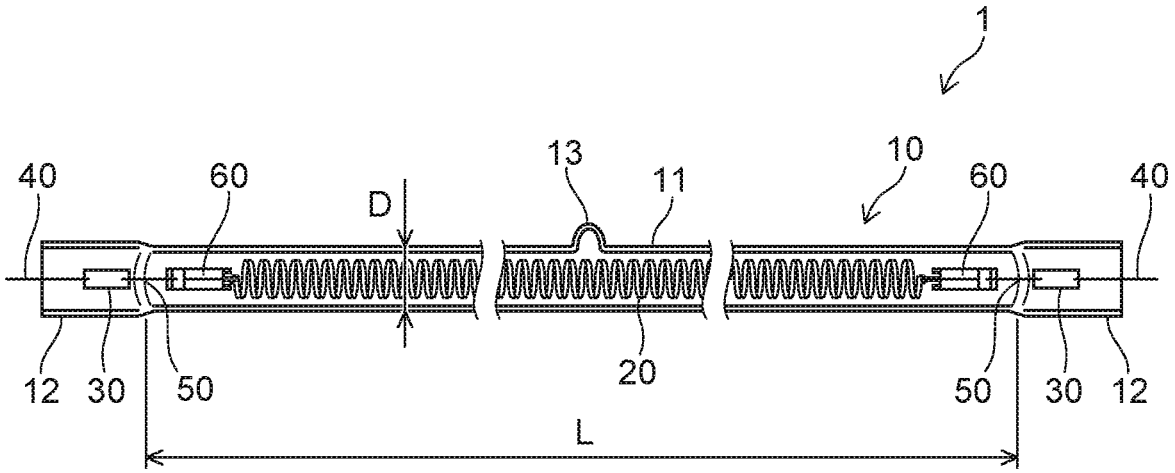
FIG. 1 is a schematic view illustrating a heater according to an embodiment.

A heater according to an embodiment includes: a tubular portion; a sealing portion which is provided in each of both end portions of the tubular portion; a conductive portion which is provided inside each sealing portion; a heating portion which is provided inside the tubular portion, extends along a tube axis of the tubular portion, and includes carbons; an inner lead which is provided in each sealing portion so that one end portion side is connected to the conductive portion and the other end portion side is exposed into the tubular portion; and a connection portion which is connected to each of both end portions of the heating portion inside the tubular portion. A bent portion is provided in an end portion opposite to the conductive portion in each inner lead. The bent portion is bent in a direction in which the sealing portions face each other and is provided inside a hole of the connection portion.

Hereinafter, embodiments will be illustrated with reference to the drawings. Additionally, in the drawings, the same reference numerals will be given to the same components and a detailed description thereof will be omitted appropriately.

A heater 1 according to the embodiment can heat an object or a space in which the object is placed. For example, the heater 1 can be used for drying ink or the like in a process of drying a printed matter or the like or for drying a paint or the like in a coating drying process. However, the application of the heater 1 according to the embodiment is not limited thereto.

FIG. 1 is a schematic view illustrating the heater 1 according to the embodiment.

As illustrated in FIG. 1, the heater 1 can be provided with a bulb 10, a heating portion 20, a conductive portion 30, an outer lead 40, an inner lead 50, and a connection portion 60.

The bulb 10 can include a tubular portion 11, a sealing portion 12, and a protrusion portion 13. The bulb 10 can be obtained by integrally forming the tubular portion 11, the sealing portion 12, and the protrusion portion 13. The bulb 10 can be formed of, for example, quartz glass. In this case, the bulb 10 can be formed of, for example, transparent, that is, uncolored quartz glass. Additionally, the bulb 10 can be formed of uncolored quartz glass or can be formed of colored quartz glass.

The tubular portion 11 can have, for example, a cylindrical shape. The tubular portion 11 can have a form in which the entire length L (the length in the tube axis direction) is longer than the tube outer diameter D which is the outer diameter of the tubular portion 11. In this case, when the tube wall load of the inner wall of the tubular portion 11 increases too much, the temperature of the tubular portion 11 also increases too much. Accordingly, there is concern that the tubular portion 11 may be deformed or the durability of the tubular portion 11 may deteriorate. For that reason, the tube outer diameter D and the entire length L of the tubular portion 11 can be set appropriately so as not to exceed a predetermined tube wall load in response to the electric power of the heater 1.

Further, a reflection film can be provided on the outer peripheral surface of the tubular portion 11. If the reflection film is provided, it is possible to reflect light including infrared rays toward a direction in which an object is placed. For that reason, the irradiation efficiency can be improved. The reflection film can include, for example, gold, aluminum oxide, and the like.

A gas can be filed into the internal space of the tubular portion 11. The gas can be filled so that heat generated in the heating portion 20 is not easily transferred to the tubular portion 11. For that reason, the gas is desirably a gas having low thermal conductivity. The gas may be, for example, one kind of argon (Ar), xenon (Xe), krypton (Kr), and neon (Ne) or a mixed gas obtained by the combination of a plurality of kinds of gases.

A pressure (sealing pressure) of a gas at 25° C. in the internal space of the tubular portion 11 can be set to, for example, a pressure range from 0.6 bar (60 kPa) to 0.9 bar (90 kPa). Here, a pressure (sealing pressure) of a gas at 25° C. in the internal space of the tubular portion 11 can be obtained by a standard state (standard ambient temperature and pressure (SATP): temperature 25° C., 1 bar) of the gas.

The sealing portion 12 can be provided in each of both end portions of the tubular portion 11 in the tube axis direction. When the sealing portion 12 is provided in both ends of the tubular portion 11, the internal space of the tubular portion 11 can be sealed airtightly. For example, the pair of sealing portions 12 can be formed by pressing both end portions of the heated tubular portion 11. For example, the pair of sealing portions 12 can be formed by using a pinch seal method or a shrink seal method. When the sealing portion 12 is formed by using the pinch seal method, the plate-shaped sealing portion 12 illustrated in FIG. 1 can be formed. When the sealing portion 12 is formed by using the shrink seal method, the cylindrical sealing portion 12 can be formed.

The protrusion portion 13 can be provided on the outer surface of the tubular portion 11. The protrusion portion 13 can be provided in order to exhaust the internal space of the tubular portion 11 or introduce the above-described gas into the internal space of the tubular portion 11 at the time of manufacturing the heater 1. The protrusion portion 13 can be formed by burning off a tube formed of quartz glass after an exhaust and a gas are introduced.

The heating portion 20 can include carbon. The heating portion 20 can be formed in, for example, a spiral shape. The heating portion 20 can be formed, for example, by spirally winding a strip-shaped mesh structure including carbon or a linear body including carbon fibers. The general shape of the heating portion 20 can be, for example, a cylindrical shape. The heating portion 20 can be provided in the internal space of the tubular portion 11. The heating portion 20 can be formed so as to extend along the tube axis of the tubular portion 11 in the center region of the tubular portion 11. The heating portion 20 can generate heat and emit light including infrared rays when energized. Additionally, the heating portion 20 may be, for example, a tubular mesh structure including carbon fibers, a stripe-shaped body including carbon, a linear body including carbon, or the like. The heating portion 20 illustrated in FIG. 1 is obtained by spirally winding a stripe-shaped mesh structure including carbon fibers.

Both end portions of the heating portion 20 can extend along the tube axis of the tubular portion 11. Each of both end portions of the heating portion 20 is connected to the connection portion 60 in the internal space of the tubular portion 11. Further, the heating portion 20 can be pulled when both end portions of the heating portion 20 are connected to the connection portion 60. In this way, it is possible to suppress the heating portion 20 from contacting the inner wall of the tubular portion 11.

One conductive portion 30 can be provided in one sealing portion 12. The conductive portion 30 can be provided inside the sealing portion 12. The planar shape of the conductive portion 30 can be a square. The conductive portion 30 can have a thin film shape. The conductive portion 30 can be formed by, for example, a molybdenum foil.

One outer lead 40 can be provided in one conductive portion 30. One outer lead 40 illustrated in FIG. 1 is provided in one conductive portion 30. The outer lead 40 can have a linear shape. In each sealing portion 12, one end portion side of the outer lead 40 is provided inside the sealing portion 12 and the other end portion side thereof can be exposed from the sealing portion 12. The outer lead 40 can include, for example, molybdenum or the like. The outer lead 40 is connected to the conductive portion 30 inside the sealing portion 12. For example, the outer lead 40 can be laser-welded or resistance-welded to the conductive portion 30.

A power-supply or the like provided outside the heater 1 can be electrically connected to the outer lead 40. For example, the outer lead 40 can be connected to a connector, a harness, or the like and the outer lead 40 can be electrically connected to a power-supply or the like through a cable provided in the connector, the harness, or the like.

When the heating portion 20 includes carbon, a peak occurs in the energy of emitted light at wavelengths of 2 μm to 4 μm. Since the peak of the absorption spectrum of water is around 3 μm, an object having a high water content can be efficiently heated by using the heating portion 20 including carbon. However, in the case of the heating portion 20 including carbon, the heating portion 20 is not easily and directly connected to the conductive portion 30. For that reason, the heater 1 is provided with the inner lead 50 and the connection portion 60.

At least one inner lead 50 can be provided in one conductive portion 30. One inner lead 50 illustrated in FIG. 1 is provided in one conductive portion 30. The inner lead 50 can be provided on the side opposite to the outer lead 40 in the conductive portion 30. The inner lead 50 can have a linear shape. In each sealing portion 12, one end portion side of the inner lead 50 can be provided inside the sealing portion 12 and the other end portion side thereof can be exposed into the tubular portion 11.

Figure 5A:
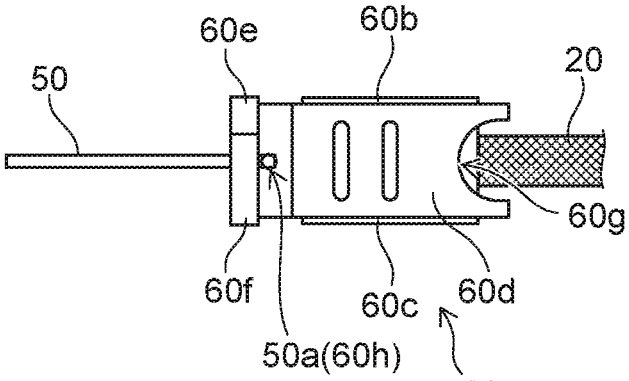
FIG. 5A is a schematic plan view illustrating a connection between the connection portion according to the embodiment and the inner lead according to the embodiment and FIG. 5B is a schematic side view illustrating a connection between the connection portion according to the embodiment and the inner lead according to the embodiment.
Figure 5B:
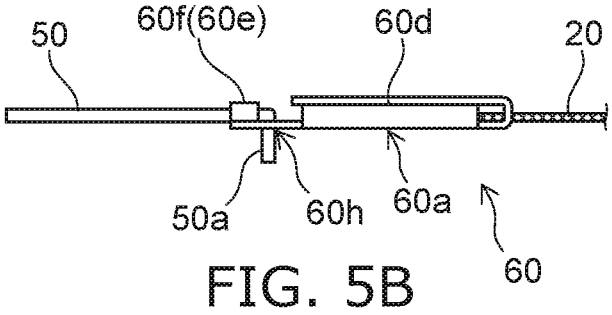

Further, a bent portion **50*a* can be provided in the end portion opposite to the conductive portion 30 in the inner lead 50 (see FIG. 5B). The bent portion 50***a* can be bent in a direction intersecting a direction in which the sealing portions 12 face each other. For example, the bent portion 50*a* can be formed by bending the vicinity of the end portion of the linear inner lead 50. Additionally, an action of the bent portion 50*a* will be described in detail later.

The inner lead 50 can include, for example, molybdenum or the like. The inner lead 50 is connected to the conductive portion 30 inside the sealing portion 12. For example, the inner lead 50 can be laser-welded or resistance-welded to the conductive portion 30.

The connection portion 60 can be provided in the internal space of the tubular portion 11. One connection portion 60 can be connected to each of both end portions of the heating portion 20. That is, the connection portion 60 is connected to the heating portion 20 and the inner lead 50. In addition, the connection between the connection portion 60 and the heating portion 20 and the connection between the connection portion 60 and the inner lead 50 will be described in detail later.

The connection portion 60 can be formed of a material having heat resistance and conductivity. The connection portion 60 can include, for example, metal such as nickel or nickel alloy.

Figure 2A:
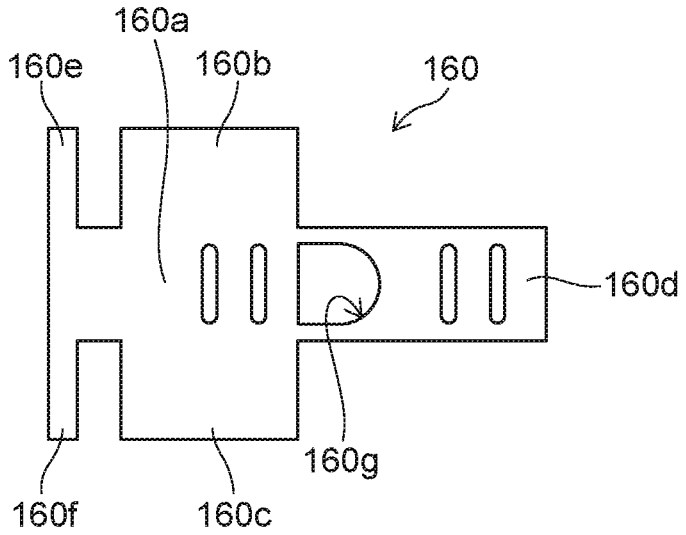
FIG. 2A is a schematic development view of a connection portion according to a comparative example.

FIG. 2A is a schematic development view of a connection portion 160 according to a comparative example.

Figure 2B:
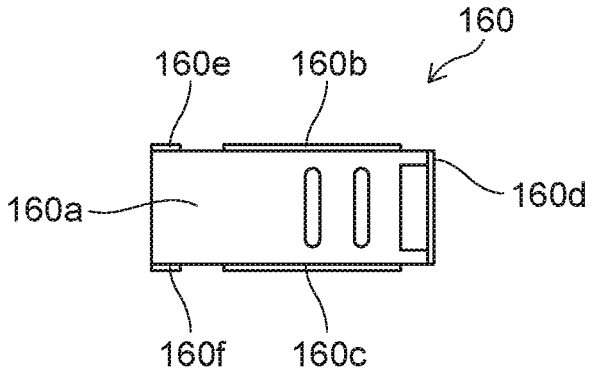
FIG. 2B is a schematic plan view illustrating the connection portion before connecting an inner lead and a heating portion.

FIG. 2B is a schematic plan view illustrating the connection portion 160 before connecting an inner lead 150 and the heating portion 20.

Figure 2C:
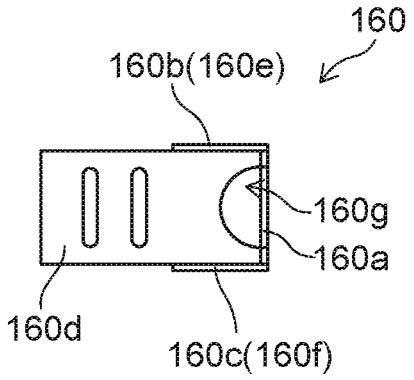
FIGS. 2C and 2D are schematic side views illustrating the connection portion before connecting the inner lead and the heating portion.
Figure 2D:
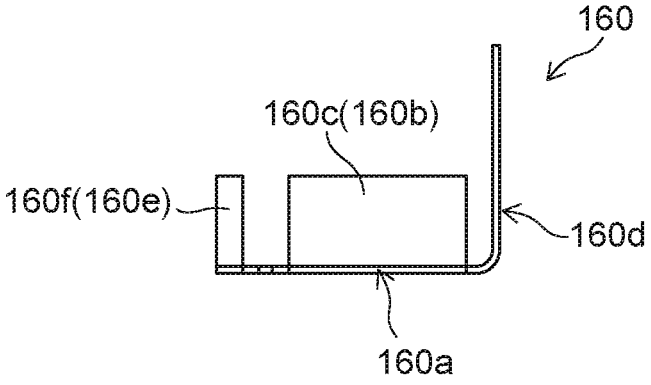

FIGS. 2C and 2D are schematic side views illustrating the connection portion 160 before connecting the inner lead 150 and the heating portion 20.

Figure 3A:
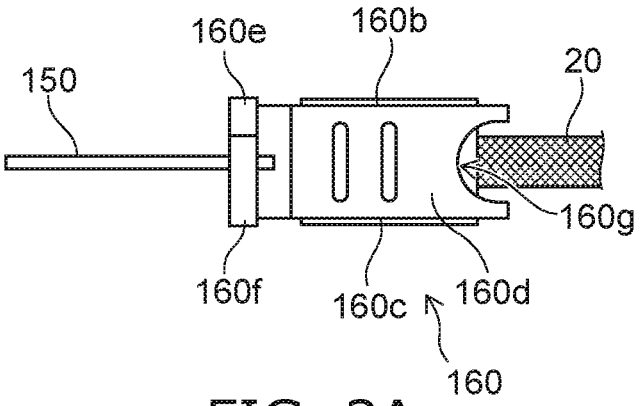
FIG. 3A is a schematic plan view illustrating a connection between a connection portion according to a comparative example and an inner lead according to a comparative example and FIG. 3B is a schematic side view illustrating a connection between the connection portion according to the comparative example and the inner lead according to the comparative example.

FIG. 3A is a schematic plan view illustrating a connection between the connection portion 160 according to the comparative example and the inner lead 150 according to the comparative example.

Figure 3B:
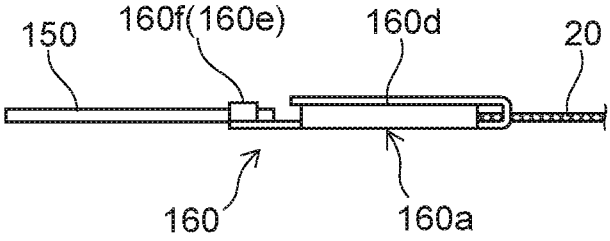

FIG. 3B is a schematic side view illustrating a connection between the connection portion 160 according to the comparative example and the inner lead 150 according to the comparative example.

As illustrated in FIG. 2A, the connection portion 160 includes a base portion 160*a* and holding portions 160*b* to 160*f*.

At the time of connecting the inner lead 150 and the heating portion 20 to the connection portion 160, first, as illustrated in FIGS. 2B to 2D, the holding portions 160*b* to 160*f* are bent in the same direction with respect to the surface of the base portion 160*a*.

Next, an end portion of the heating portion 20 is inserted into a hole 160*g*.

Next, as illustrated in FIGS. 3A and 3B, the holding portions 160*b* and 160*c* are bent toward the base portion 160*a* and the vicinity of the end portion of the heating portion 20 is pressed. Subsequently, the holding portion 160*d* is bent toward the holding portions 160*b* and 160*c* and the holding portion 160*d* is welded to the holding portions 160*b* and 160*c*.

In this way, the heating portion 20 is connected to the connection portion 160.

Further, the vicinity of the end portion of the inner lead 150 is welded to the surface of the base portion 160*a*.

Next, as illustrated in FIGS. 3A and 3B, the holding portions 160*e* and 160*f* are bent toward the base portion 160*a* and the vicinity of the end portion of the inner lead 150 is pressed.

Subsequently, the holding portion 160*e* and the holding portion 160*f* are welded to each other.

In this way, the inner lead 150 is connected to the connection portion 160.

Here, in recent years, higher power heaters are required. For example, the heater 1 having power density of 4.5 W (watt)/mm (millimeter) or more is desirable and the heater 1 having power density of 5 W/mm or more is further desirable.

Incidentally, when the power density is 4.5 W/mm, the temperature of the connection portion 160 and the inner lead 150 is about 480° C. in some cases. When the temperature of the connection portion 160 and the inner lead 150 is about 480° C., a crack easily occurs in a portion in which the inner lead 150 and the base portion 160*a* are welded to each other. As described above, when both end portions of the heating portion 20 are held by the connection portion 160, the heating portion 20 is pulled. For that reason, when a crack occurs in the welded portion, the connection portion 160 is pulled by the heating portion 20 and the inner lead 150 is separated from the connection portion 160 in some cases. For that reason, there is concern that the life of the heater is shortened although the heating portion 20 and the like are not abnormal.

Figure 4A:
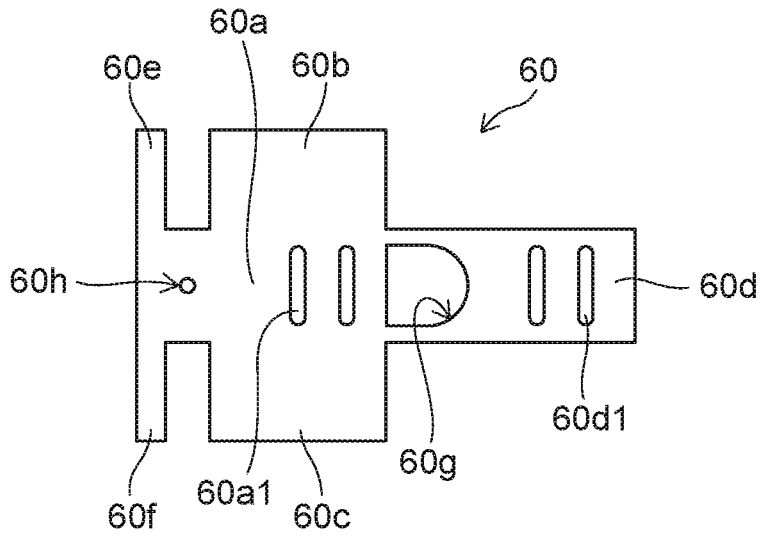
FIG. 4A is a schematic development view of a connection portion according to an embodiment.

FIG. 4A is a schematic development view of the connection portion 60 according to the embodiment.

Figure 4B:
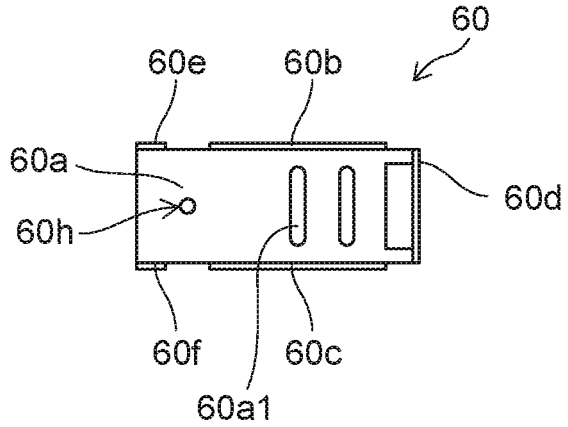
FIG. 4B is a schematic plan view illustrating the connection portion before connecting an inner lead and a heating portion.

FIG. 4B is a schematic plan view illustrating the connection portion 60 before connecting the inner lead 50 and the heating portion 20.

Figure 4C:
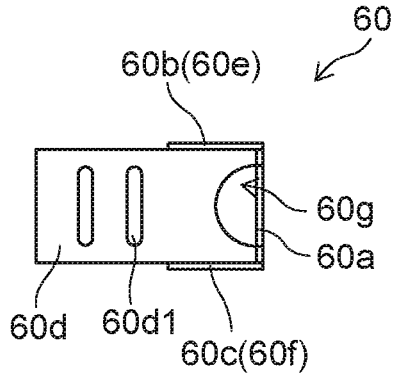
FIGS. 4C and 4D are schematic side views illustrating the connection portion before connecting the inner lead and the heating portion.
Figure 4D:
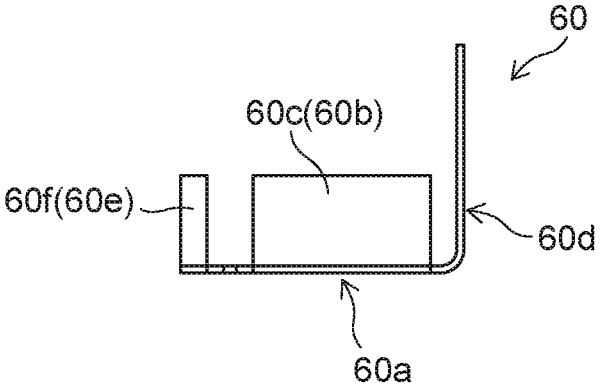

FIGS. 4C and 4D are schematic side views illustrating the connection portion 60 before connecting the inner lead 50 and the heating portion 20.

FIG. 5A is a schematic plan view illustrating a connection between the connection portion 60 according to the embodiment and the inner lead 50 according to the embodiment.

FIG. 5B is a schematic side view illustrating a connection between the connection portion 60 according to the embodiment and the inner lead 50 according to the embodiment.

As illustrated in FIG. 4A, the connection portion 60 can include a base portion 60*a* and holding portions 60*b* to 60*f*. The base portion 60*a* and the holding portions 60*b* to 60*f* can be integrally formed by, for example, a press-molding method or the like.

The base portion 60*a* can have a plate shape. The base portion 60*a* can include a convex portion 60*a*1 which protrudes from one surface. At least one convex portion 60*a*1 can be provided. The convex portion 60*a*1 can be provided in the vicinity of the end portion on the side of the holding portion 60*d* in the base portion 60*a*. The convex portion 60*a*1 can extend in a direction in which the holding portion 60*c* and the holding portion 60*d* face each other. The convex portion 60*a*1 can be formed by, for example, a press-molding method or the like.

Further, the base portion 60*a* can include a hole 60*h* which penetrates in the thickness direction. The hole 60*h* can be provided in the vicinity of the end portion opposite to the installation side of the convex portion 60*a*1 in the base portion 60*a*. The hole 60*h* can be formed by, for example, a press-molding method or the like. The number of the holes 60*h* can be the same as the number of the inner leads 50. The diameter dimension of the hole 60*h* can be slightly larger than the thickness of the inner lead 50. The bent portion 50*a* of the inner lead 50 can be inserted into the hole 60*h*.

The holding portion 60*b* can be provided in the end portion in a direction intersecting the arrangement direction of the convex portion 60*a*1 and the hole 60*h* in the base portion 60*a*. The holding portion 60*c* can be provided in the end portion opposite to the installation side of the holding portion 60*b* in the base portion 60*a*. The holding portion 60*c* can be provided at a position facing the holding portion 60*b*. The holding portions 60*b* and 60*c* can be provided in the vicinity of an end portion on the installation side of the convex portion 60*a*1 in the base portion 60*a*. Each of the holding portions 60*b* and 60*c* can have a plate shape and protrude from the end portion of the base portion 60*a*.

The holding portion 60*d* can be provided in the end portion on the installation side of the convex portion 60*a*1 in the base portion 60*a* in a direction intersecting a direction in which the holding portion 60*b* faces the holding portion 60*c*. The holding portion 60*d* can have a plate shape and protrude from the end portion of the base portion 60*a*. The holding portion 60*d* can include a hole 60*g* penetrating in the thickness direction. The hole 60*g* can be provided in the end portion on the side of the base portion 60*a* in the holding portion 60*d*. A part of the hole 60*g* can be provided in the base portion 60*a*. The diameter dimension of the hole 60*g* can be slightly larger than the thickness of the end portion of the heating portion 20. The end portion of the heating portion 20 can be inserted into the hole 60*g*.

Further, the holding portion 60*d* can be provided with at least one convex portion 60*d*1. The convex portion 60*d*1 can be formed by, for example, a press-molding method or the like. The convex portion 60*d*1 can protrude in a direction in which the convex portion 60*a*1 protrudes from the surface of the holding portion 60*d*. The convex portion 60*d*1 can extend in the extension direction of the convex portion 60*a*1. The convex portion 60*d*1 can be provided at a position not interfering with the convex portion 60*a*1 when the holding portion 60*d* is bent toward the base portion 60*a*.

The holding portion 60*e* can be provided in the end portion on the installation side of the holding portion 60*b* in the base portion 60*a*. The holding portion 60*f* can be provided in the end portion opposite to the installation side of the holding portion 60*b* in the base portion 60*a*. The holding portion 60*f* can be provided at a position facing the holding portion 60*e*. The holding portions 60*e* and 60*f* can be provided in the vicinity of the end portion on the installation side of the hole 60*h* in the base portion 60*a*. Each of the holding portions 60*e* and 60*f* can have a plate shape and protrude from the end portion of the base portion 60*a*.

At the time of connecting the inner lead 50 and the heating portion 20 to the connection portion 60, first, as illustrated in FIGS. 4B to 4D, the holding portions 60*b* to 60*f* are bent toward the protrusion side of the convex portion 60*a*1 in the base portion 60*a*.

Next, the end portion of the heating portion 20 is inserted into the hole 60*g*.

Next, as illustrated in FIGS. 5A and 5B, the holding portions 60*b* and 60*c* are bent toward the base portion 60*a* and the vicinity of the end portion of the heating portion 20 is pressed.

Subsequently, the holding portion 60*d* is bent toward the holding portions 60*b* and 60*c* and the holding portion 60*d* is welded to the holding portions 60*b* and 60*c*. For example, the holding portion 60*d* can be welded to the holding portions 60*b* and 60*c* by using a resistance-welding method.

In this way, the heating portion 20 can be connected to the connection portion 60.

Further, the bent portion 50*a* of the inner lead 50 is inserted into the hole 60*h*. Subsequently, the vicinity of the end portion on the side opposite to the conductive portion 30 in the inner lead 50 is welded to the base portion 60*a*. For example, the vicinity of the end portion of the inner lead 50 can be welded to the base portion 60*a* by using a laser-welding method or the like.

Next, as illustrated in FIGS. 5A and 5B, the holding portions 60*e* and 60*f* are bent toward the base portion 60*a* and the vicinity of the end portion of the inner lead 50 is pressed. Subsequently, the holding portion 60*e* is welded to the holding portion 60*f*. For example, the holding portion 60*e* and the holding portion 60*f* can be welded by using a resistance-welding method.

In this way, the inner lead 50 can be connected to the connection portion 60.

As described above, when the power density is 4.5 W/mm, the temperature of the connection portion 60 and the inner lead 50 becomes about 480° C. For that reason, a crack or the like easily occurs in a portion in which the inner lead 50 and the base portion 60*a* are welded to each other.

In the embodiment, the bent portion 50*a* of the inner lead 50 is provided inside the hole 60*h*. For that reason, since the bent portion 50*a* is caught on the inner wall of the hole 60*h* even when a crack occurs in the welded portion, it is possible to suppress the inner lead 50 from being separated from the connection portion 60. For that reason, it is possible to extend the life of the heater 1.

According to the knowledge of the inventor, it is possible to suppress the inner lead 50 from being separated from the connection portion 60 even when the power density becomes 5 W/mm or more and the temperature of the connection portion 60 and the inner lead 50 becomes 480° C. or more. For that reason, in the heater 1 according to the embodiment, higher power and longer life of the heater 1 can be achieved.

Figure 6A:
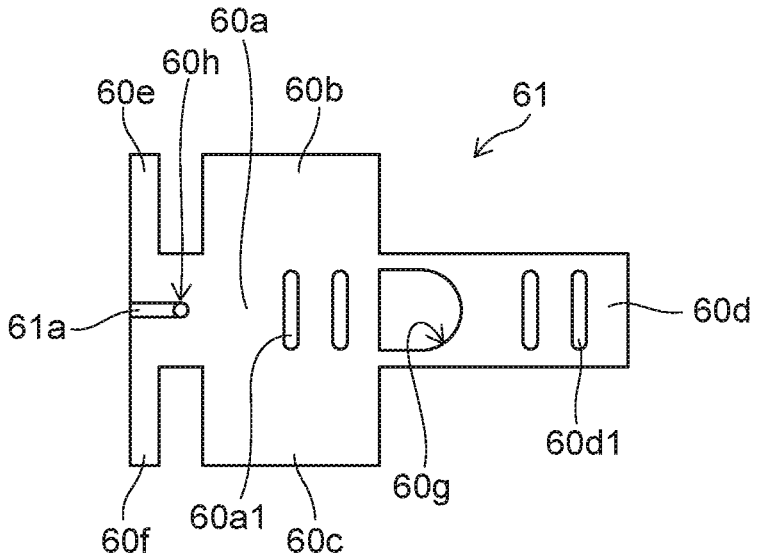
FIG. 6A is a schematic development view illustrating a connection portion according to another embodiment.

FIG. 6A is a schematic development view of a connection portion 61 according to another embodiment.

Figure 6B:
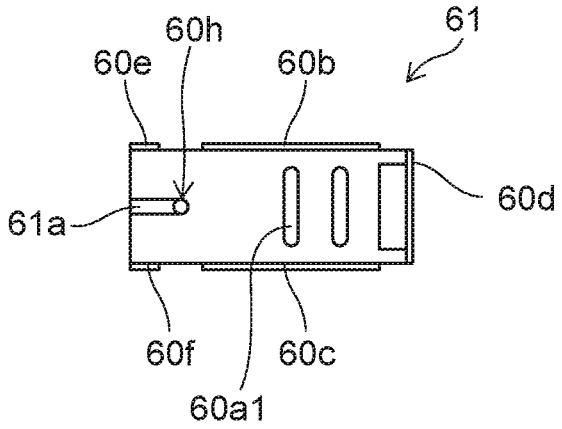
FIG. 6B is a schematic plan view illustrating the connection portion before connecting an inner lead and a heating portion.

FIG. 6B is a schematic plan view illustrating the connection portion 61 before connecting the inner lead 50 and the heating portion 20.

Figure 6C:
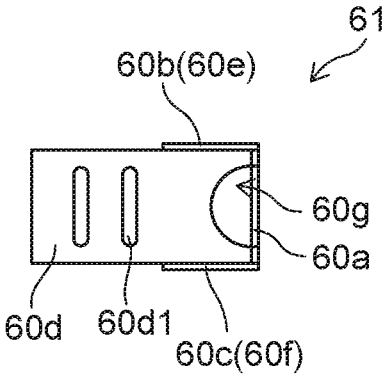
FIGS. 6C and 6D are schematic side views illustrating the connection portion before connecting the inner lead and the heating portion.
Figure 6D:
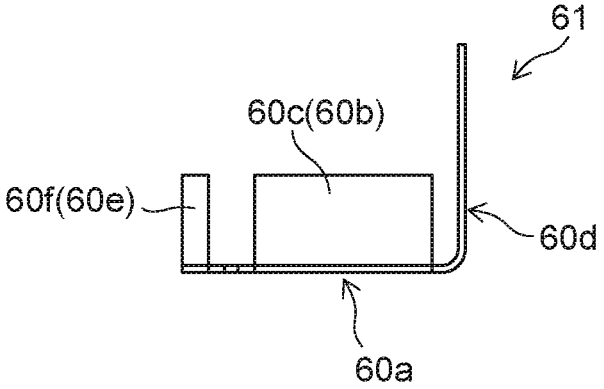

FIGS. 6C and 6D are schematic side views illustrating the connection portion 61 before connecting the inner lead 50 and the heating portion 20.

As illustrated in FIGS. 6A and 6B, the connection portion 61 can include a groove 61*a*. That is, the connection portion 61 can have a configuration in which the groove 61*a* is provided in the connection portion 60. The groove 61*a* can open to a surface on the protrusion side of the convex portion 60*a*1 in the base portion 60*a*. The groove 61*a* can extend between the hole 60*h* and an end face opposite to the installation side of the holding portion 60*d* in the base portion 60*a*. One end portion of the groove 61*a* can be connected to the hole 60*h*. The other end portion of the groove 61*a* can open to an end face on the side of the conductive portion 30 in the connection portion 61 (the base portion 60*a*). At least one of both side surfaces of the groove 61*a* can contact the inner lead 50. Further, the bottom surface of the groove 61*a* can contact the inner lead 50.

If the groove 61*a* is provided, it is possible to suppress the movement of the position of the inner lead 50 when the bent portion 50*a* of the inner lead 50 is inserted into the hole 60*h*. For that reason, it is possible to improve the adhesion between the inner lead 50 and the base portion 60*a* when the inner lead 50 is pressed by the holding portions 60*e* and 60*f*.

Further, the welding between the inner lead 50 and the connection portion 61 (the base portion 60*a*) can be omitted. No crack occurs when there is no welding portion. Further, manufacturing cost can be decreased. In addition, the inner lead 50 and the connection portion 61 (the base portion 60*a*) may be welded to each other.

Further, in the description above, the groove 61*a* provided with the inner lead 50 has been illustrated, but a configuration may be employed in which a plurality of convex portions protruding from the surface of the base portion 60*a* is provided and the inner lead 50 is provided between the convex portion and the convex portion.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions. Moreover, above-mentioned embodiments can be combined mutually and can be carried out.

What is claimed is:

1. A heater comprising:

a tubular portion;

a pair of sealing portions comprising a first sealing portion provided in a first end portion of the tubular portion, and a second sealing portion provided in a second end portion of the tubular portion;

a pair of conductive portions comprising a first conductive portion provided inside the first sealing portion, and a second conductive portion provided inside the second sealing portion;

a heating portion provided inside the tubular portion, the heating portion extending along a tube axis of the tubular portion, and including carbons;

a pair of inner leads comprising a first inner lead provided in the first sealing portion so that one end portion side is connected to the first conductive portion and the other end portion side is exposed into the tubular portion, and a second inner lead provided in the second sealing portion so that one end portion side is connected to the second conductive portion and the other end portion side is exposed into the tubular portion;

a pair of connection portions comprising a first connection portion connected to one end portion of the heating portion inside the tubular portion, the first connection portion including a first plate-shaped base portion, the first base portion including a first hole which penetrates the first base portion in a thickness direction, and a second connection portion connected to the other end portion of the heating portion inside the tubular portion, the second connection portion including a second plate-shaped base portion, the second base portion including a second hole which penetrates the second base portion in a thickness direction; and a pair of bent portions comprising a first bent portion provided in an end portion opposite to the first conductive portion in the first inner lead, and a second bent portion provided in an end portion opposite to the second conductive portion in the second inner lead, and wherein the first bent portion is bent in a direction in which the first and second sealing portions face each other and is provided inside the first hole of the first base portion, and the second bent portion is provided inside the second hole of the second base portion.

2. The heater according to claim 1, wherein the first connection portion further includes a first groove, the second connection portion further includes a second groove, one end portion of the first groove is connected to the first hole, one end portion of the second groove is connected to the second hole, the other end portion of the first groove opens to an end face on the side of the first conductive portion in the first base portion, the other end portion of the second groove opens to an end face on the side of the second conductive portion in the second base portion, at least one of both side surfaces of the first groove contacts the first inner lead, and at least one of both side surfaces of the second groove contacts the second inner lead.

3. The heater according to claim 1, wherein the first base portion includes at least one first convex portion which protrudes from one surface, and the second base portion includes at least one second convex portion which protrudes from one surface.

4. The heater according to claim 3, wherein the first hole is provided in the vicinity of a first end portion opposite to an installation side of the first convex portion in the first base portion, and the second hole is provided in the vicinity of a second end portion opposite to an installation side of the second convex portion in the second base portion.

5. The heater according to claim 3, wherein the first connection portion further includes a first holding portion which is provided in an end portion in a direction intersecting an arrangement direction of the first convex portion and the first hole in the first base portion and has a plate shape, a second holding portion which is provided in an end portion opposite to an installation side of the first holding portion in the first base portion and has a plate shape, and a third holding portion which is provided in an end portion on an installation side of the first convex portion in the first base portion and has a plate shape, and the second connection portion further includes a fourth holding portion which is provided in an end portion in a direction intersecting an arrangement direction of the second convex portion and the second hole in the second base portion and has a plate shape, a fifth holding portion which is provided in an end portion opposite to an installation side of the fourth holding portion in the second base portion and has a plate shape, and a sixth holding portion which is provided in an end portion on an installation side of the second convex portion in the second base portion and has a plate shape.

6. The heater according to claim 5, wherein the first holding portion, the second holding portion, and the third holding portion are provided on a protrusion side of the first convex portion in the first base portion, and the fourth holding portion, the fifth holding portion, and the sixth holding portion are provided on a protrusion side of the second convex portion in the second base portion.

7. The heater according to claim 6, wherein a first end portion of the heating portion is sandwiched between each of the first holding portion, the second holding portion, and the third holding portion and the first convex portion of the first base portion, and a second end portion of the heating portion is sandwiched between each of the fourth holding portion, the fifth holding portion, and the sixth holding portion and the second convex portion of the second base portion.

8. The heater according to claim 6, wherein the third holding portion includes a third hole which penetrates the third holding portion in a thickness direction and a first end portion of the heating portion is inserted into the third hole, and the sixth holding portion includes a fourth hole which penetrates the sixth holding portion in a thickness direction and a second end portion of the heating portion is inserted into the fourth hole.

9. The heater according to claim 1, wherein each of the first connection portion and the second connection portion includes nickel or nickel alloy.

10. The heater according to claim 1, wherein the vicinity of a first end portion opposite to the first conductive portion in the first inner lead is welded to the first connection portion, and the vicinity of a second end portion opposite to the second conductive portion in the second inner lead is welded to the second connection portion.

11. The heater according to claim 1, further comprising:

a first outer lead which is provided in a first sealing portion so that one end portion side is connected to the first conductive portion and the other end portion side is exposed from the first sealing portion; and a second outer lead which is provided in the second sealing portion so that one end portion side is connected to the second conductive portion and the other end portion side is exposed from the second sealing portion.

12. The heater according to claim 1, wherein the heating portion has a spiral shape.

13. The heater according to claim 12, wherein the spiral heating portion includes a stripe-shaped mesh structure including carbons.

14. The heater according to claim 12, wherein the spiral heating portion includes a linear body including carbon fibers.

15. The heater according to claim 1, wherein the heating portion is any one of a tubular mesh structure including carbon fibers, a stripe-shaped body including carbons, and a linear body including carbons.

16. The heater according to claim 1, wherein the heating portion is able to generate heat and emit light including infrared rays when energized.

17. The heater according to claim 1, wherein a power density of the heater is 4.5 W (watt)/mm (millimeter) or more.

18. The heater according to claim 1, wherein an internal space of the tubular portion is filled with at least one gas selected from the group consisting of argon, xenon, krypton, and neon.

19. The heater according to claim 18, wherein a pressure of the gas is 0.6 bar (60 kPa) or more and 0.9 bar (90 kPa) or less.

* * * * *